United States Patent [19]

Laut

[11] Patent Number: 4,841,285

[45] Date of Patent: Jun. 20, 1989

[54] TILT-RESPONSIVE DISPLAY CASE ALARM

[76] Inventor: Jack R. Laut, P.O. Box 2555, Dunnellon, Fla. 32630

[21] Appl. No.: 189,550

[22] Filed: May 3, 1988

[51] Int. Cl.[4] ..... G08B 13/14

[52] U.S. Cl. ..... 340/571; 200/61.47; 340/689; 340/693

[58] Field of Search ..... 340/571, 689, 693; 200/61.47

[56] References Cited

U.S. PATENT DOCUMENTS

| | | | |
|---|---|---|---|
| 2,041,577 | 5/1936 | Sutherland | 340/571 |
| 2,655,579 | 10/1953 | Burroughs | 200/61.47 |
| 2,692,652 | 10/1954 | Wilson | 200/61.47 |
| 3,710,371 | 1/1973 | Whalen et al. | 340/571 |
| 3,833,084 | 9/1974 | Henderson et al. | 200/61.47 |
| 4,284,983 | 8/1981 | Lent | 340/571 |
| 4,284,984 | 8/1981 | Scarpino et al. | 340/571 |
| 4,462,023 | 7/1984 | Nielsen et al. | 340/571 |

*Primary Examiner*—Glen R. Swann, III

*Attorney, Agent, or Firm*—Jerry T. Kearns

[57] ABSTRACT

An alarm adapted for mounting in an interior corner portion of a display case has an L-shaped housing which encloses a battery, an audible alarm, a mercury activation switch and an enable/disable switch. When the alarm is mounted in the display case, end faces of legs of the L-shaped housing abut adjacent interior side walls of the display case, forming a protected rectangular space for the alarm enable/disable switch. The enable/-disable alarm switch is turned on or off by a key inserted through a small hole drilled through one side wall of the display case. The key may be in the form of a cylindrical pin for a simple push button type switch, or may have specially formed projections for engagement with a cooperating recess formed in an alternative rotary type switch. The audible alarm is set off by a mercury switch. In a first embodiment, an interior conical recess in a block of a plastic material contains an encapsulated pool of mercury. A conductor ring extends around a top portion of the recess and a second conductor is inserted into the mercury pool through the apex of the conical recess. In a second embodiment, two spaced ring shaped conductors extend coaxially adjacent a top portion of a conical recess which contains a pool of mercury. The rings and the mercury pool are encapsulated in a block of plastic.

6 Claims, 4 Drawing Sheets

TILT-RESPONSIVE DISPLAY CASE ALARM

BACKGROUND OF THE INVENTION

1. Field of the Invention

The present invention relates to alarms, and more particularly pertains to a new and improved audible alarm activated by a mercury switch specifically adapted for use with display cases. Many individual collectors of various assorted valuable items such as coins, gem stones, jewelry, guns, etc. frequently travel to display these items at shows. These various valuable collectible items are transported and displayed in display cases and frames. At a collector's show, these display cases and frames are placed horizontally on tables disposed in a large room. Because these shows are typically open to the general public, there is a high volume of traffic by a wide Variety of individuals past these various display cases. While the conventional display cases may be provided with various types of mechanical locks, this does not prevent individuals from stealing the entire display case. In order to deter this theft, the present invention provides an audible alarm which may be mounted in the interior of the display cases which is actuated by a sensitive mercury switch.

2. Description of the Prior Art

Various types of alarms are known in the prior art. A typical example of such an alarm is to be found in U.S. Pat. No. 2,041,577, which issued to C. Sutherland on May 19, 1936. This patent discloses a tear gas dispenser actuated by a mercury switch which is concealed within an artificial packet of money. the mercury switch is in the form of a V-shaped tube with conductors located at the end portions of the V-shaped tube. U.S. Pat. No. 3,710,371, which issued to G. Whalen et al on Jan. 9, 1973, discloses a portable alarm system which includes a mercury switch connected to trigger a latching type semiconductor switch, causing electrical current to energize an alarm. Once sounded, the alarm cannot be silenced unless the correct procedure or key method is followed. U.S. Pat. No. 4,284,984, which issued to J. Scarpino et al on Aug. 18, 1981, discloses an attitude change alarm for securing articles from theft or other undesired movement. The alarm includes a case having a wall which defines a hollow interior. Resistive elements are maintained within the wall in spaced relationship with each other and in common communication with an electrically conductive surface on the outside of the wall. When the alarm is moved, a current is transmitted from a conductor through the resistive elements and is passed through a transformer which activates the alarm. Various geometrical configurations of the attitude change alarm include spherical, oval, hexagonal and conical shaped recesses which enclose pools of mercury. U.S. Pat. No. 4,462,023, which issued to C. Nielsen et al on July 24, 1984, discloses a position sensitive alarm which is adapted to be mounted to an item of personal property to be protected so that if the property is moved, an audible alarm is produced. The alarm includes a housing in which a battery, a buzzer and a position sensitive switch are mounted therein. An aperture is cut in the housing so that the sound produced by the buzzer does not muffle within the housing. The components within the housing are fully enclosed except for the battery. The batteries are mounted within the open side of the battery case, which itself is mounted within the housing. The circuit, lacking an on/off switch is disarmed and armed by removal and replacement of the battery in the battery case.

While the above mentioned devices are suited for their intended usage, none of these devices disclose an audible alarm activated by a mercury switch mounted in a generally L-shaped housing for location in an interior corner portion of a display case. Additionally, none of the aforesaid alarm devices utilize a mercury switch having a conical recess containing a pool of mercury and having a conductor ring extending around a top portion of the recess and encapsulated in a block of plastic material. Furthermore, none of the aforesaid alarm devices utilize a mercury switch having a conical recess containing a pool of mercury and spaced concentric conductor rings encapsulated in a block of plastic material. Inasmuch as the art is relatively crowded with respect to these various types of alarms, it can be appreciated that there is a continuing need for and interest in improvements to such alarms, and in this respect, the present invention addresses this need and interest.

SUMMARY OF THE INVENTION

In view of the foregoing disadvantages inherent in the known types of alarms now present in the prior art, the present invention provides an improved display case alarm. As such, the general purpose of the present invention, which will be described subsequently in greater detail, is to provide a new and improved display case alarm which has all the advantages of the prior art alarms and none of the disadvantages.

To attain this, representative embodiments of the concepts of the present invention are illustrated in the drawings and make use of an L-shaped housing which encloses a battery, an audible alarm, a mercury alarm activation switch and an alarm enable/disable switch. When the alarm is mounted in an interior corner portion of a display case, the ends of the legs of the L-shaped housing abut adjacent interior side walls of the display case, forming a protected rectangular space for the alarm enable/disable switch. The alarm is turned on and off by a key inserted through a small hole drilled through one side wall of the display case. The key for the alarm enable/disable switch may be in the form of a cylindrical pin for a simple push button type switch, or may have specially formed projections for engagement with a cooperating recess formed in the enable/disable switch for a rotary type switch. The audible alarm is set off by a mercury type switch. Two separate embodiments of a highly sensitive mercury type switch are disclosed. In a first embodiment, an interior conical recess in a block of a plastic material contains an encapsulated pool of mercury. A conductor ring extends around a top portion of the recess and a second conductor is inserted into the mercury pool through the apex of the conical recess. In a second embodiment two spaced ring shaped conductors extend coaxially adjacent a top portion of a conical recess which contains a pool of mercury. The conductor rings and the mercury pool are encapsulated in a block of plastic.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved display case alarm which has all the advantages of the prior art alarms and none of the disadvantages.

It is another object of the present invention to provide a new and improved display case alarm which may be easily and efficiently manufactured and marketed.

It is a further object of the present invention to provide a new and improved display case alarm which is of a durable and reliable construction.

An even further object of the present invention is to provide a new and improved display case alarm which is susceptible of a low cost of manufacture with regard to both materials and labor, and which accordingly is then susceptible of low prices of sale to the consuming public, thereby making such alarms economically available to the buying public.

Still yet another object of the present invention is to provide a new and improved display case alarm which provides in the apparatuses and methods of the prior art some of the advantages thereof, while simultaneously overcoming some of the disadvantages normally associated therewith.

Still another object of the present invention is to provide a new and improved display case alarm which utilizes a generally L-shaped housing for mounting in a protected interior corner of a display case.

Yet another object of the present invention is to provide a new and improved display case alarm which is activated by an improved form of mercury switch.

Even still another object of the present invention is to provide a new and improved display case alarm which utilizes a mercury switch having a pool of mercury in a conical recess encapsulated in a block of plastic material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
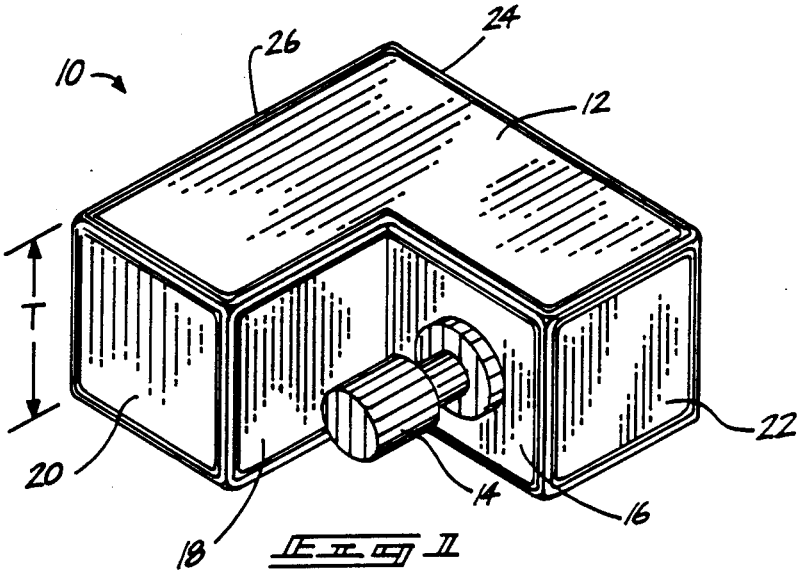
FIG. 1 is a perspective view of the display case alarm of the present invention.

With reference now to the drawings, and in particular to FIG. 1 thereof, a new and improved display case alarm embodying the principles and concepts of the present invention and generally designated by the reference numeral 10 will be described.

More specifically, it will be noted that the first embodiment 10 of the invention includes a generally L-shaped housing 12. The leg portions of the housing 12 have a generally rectangular transverse cross sectional shape and have rectangular end faces 20 and 22. An enable/disable switch 14 extends from an interior side wall 16 of a first leg of the L-shaped housing 12. A second interior rectangular side wall 18 of a second leg of the housing 12 extends at a right angle to the side wall 16. In use, the end faces 22 and 20 abut adjacent interior side walls of a display case. This locates the enable/disable switch 14 in a protected rectangular recess. The first leg of the L-shaped housing 12 has an exterior side wall 24 and the second leg has an exterior side wall 26.

Figure 2:
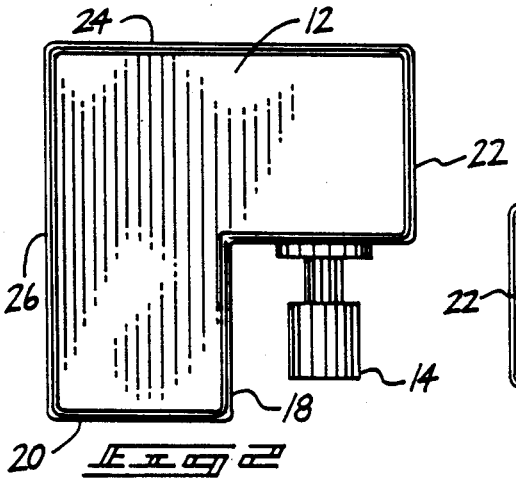
FIG. 2 is a top view of the display case alarm of the present invention.

In FIG. 2, a top view of the display case alarm 10 is provided.

Figure 3:
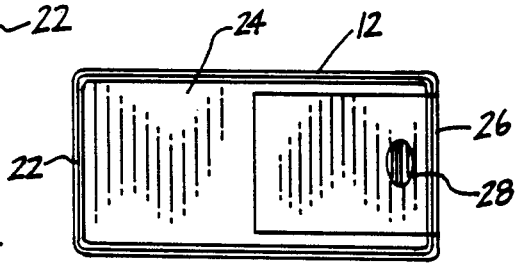
FIG. 3 is a back end view of the display case alarm of the present invention.
Figure 4:
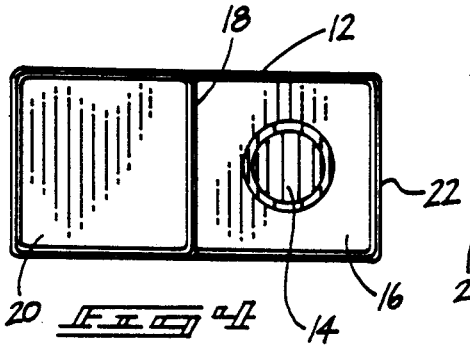
FIG. 4 is a front end view of the display case alarm of the present invention.
Figure 5:
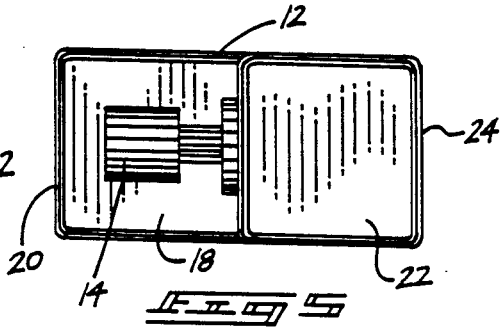
FIG. 5 is a side view of the display case alarm of the present invention.

In FIG. 3, a back end view of the display case alarm 10 illustrates the opening grill of an audible alarm 28. When installed in a display case the alarm grill 28, which is located on the exterior side wall 24 of the first leg portion of the L-shaped housing 12, is directed toward the open interior of the display case, so as not to muffle the audible alarm.

Figure 6:
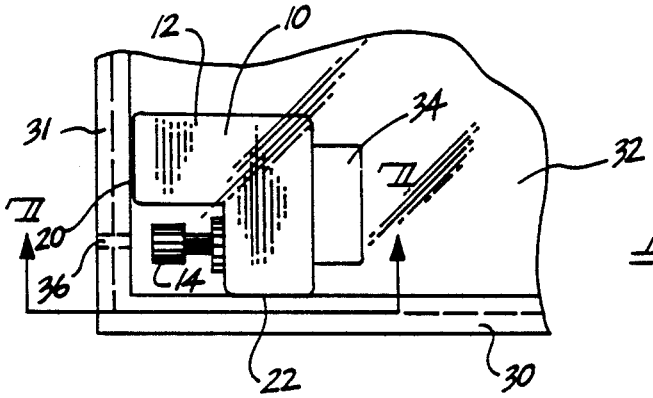
FIG. 6 is a top plan view illustrating the manner of mounting the display case alarm of the present invention in a display case.

In FIG. 6, a top view illustrates the manner of mounting the display case alarm 10 in a display case. The end faces 20 and 22 abut adjacent interior side walls 31 and 30 of the display case. The display case is covered by a glass panel 32 which may be of the type which opens by sliding or pivoting movement. A block 34, secured to an interior floor portion of the display case, Wedges the L-shaped housing 12 in the illustrated position. An aperture 36 drilled through the side wall 31 of the display case is in alignment with the enable/disable switch 14. A key for operating the switch 14 is inserted through the aperture 36. As may now be understood, the switch 14 is located in an enclosed rectangular recess within the interior of the display case. This protects the enable/disable switch from being accidentally turned on or off. Also, due to the display case construction, the switch 14 is inaccessible from the interior of the display case and must be actuated by a key through the aperture 36. This protects the switch 14 from unauthorized tampering.

Figure 7:
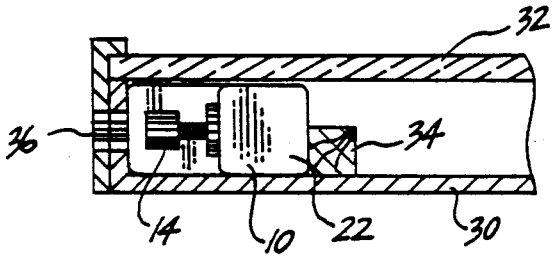
FIG. 7 is a cross sectional view, taken along line 7—7 of FIG. 6, further illustrating the mounting of the display case alarm of the present invention in a display case.

In FIG. 7, a cross sectional view taken along line 7—7 of FIG. 6 further illustrates the mounting of the display case alarm 10.

Figure 8:
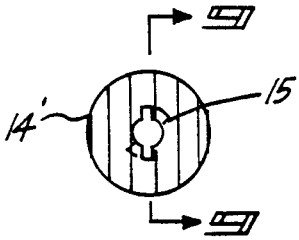
FIG. 8 is an end view of a modified form of enable/-disable switch for use in the display case alarm of the present invention.

In FIG. 8, a modified form of the enable/disable switch 14 is illustrated. Instead of utilizing a two position push button type switch, a rotary switch 14' is employed. A recess 15 is formed in the end of the switch 14' for the reception of a correspondingly shaped key.

Figure 9:
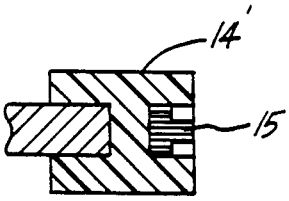
FIG. 9 is a cross sectional view, taken along line 9—9 of FIG. 8, further illustrating the modified form of enable/disable switch.

FIG. 9 further illustrates the construction of the modified form of enable/disable switch 14'.

Figure 10:
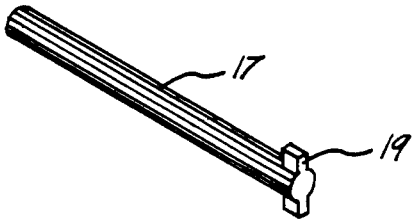
FIG. 10 is a perspective view illustrating a key for use with the enable/disable switch of FIGS. 8 and 9.

FIG. 10 illustrates a key suitable for use with the modified form of switch 14'. An elongated cylindrical shank 17 has an end portion 19 formed with cooperating projections to engage the recess 15 on the end face of the switch 14'. In use, the key 17 is inserted through an appropriately dimensioned aperture in the side wall of a display case and into engagement with the recess 15 formed in the end face of the switch 14'. The shank 17 of the key is then rotated to operate the switch.

Figure 11:
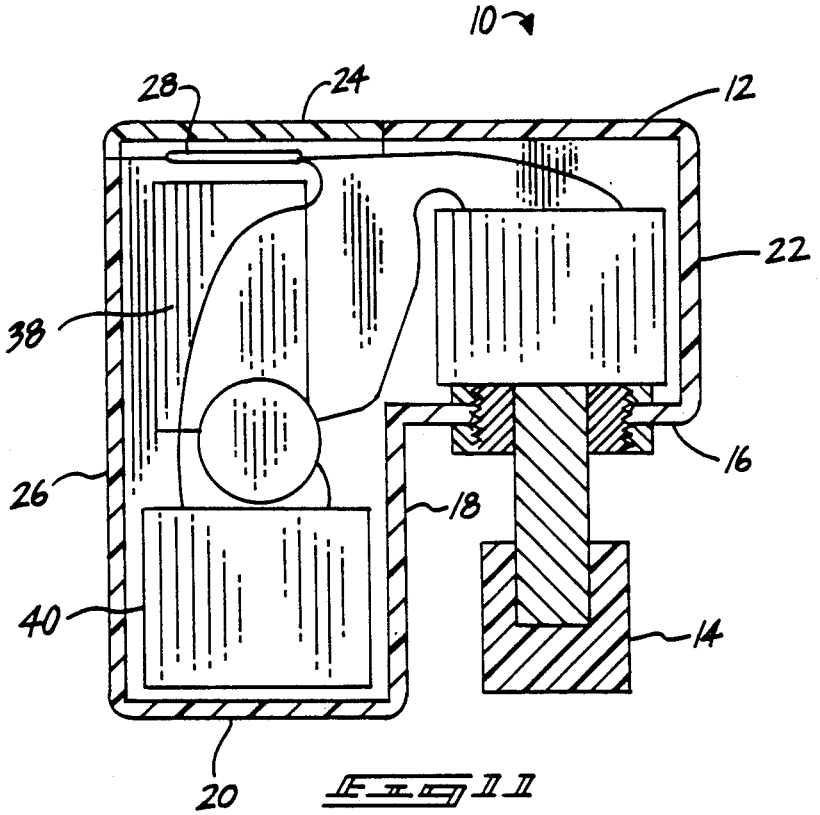
FIG. 11 is a cross sectional view illustrating the interior components of the display case alarm of the present invention.

FIG. 11 illustrate the internal components of the display case alarm 1 of the present invention. The enable/disable switch 14 is preferably of a push button type and extends from the interior side face 16 of a first leg portion of the L-shaped housing 12. The audible alarm 28 is disposed within the housing 12, on the bottom side of the housing with the grill in the bottom of the case. A mercury type switch 40 and a battery 38 are also received within the housing 12. The elements may be secured within the housing by encapsulating in an epoxy or other potting material.

Figure 12:
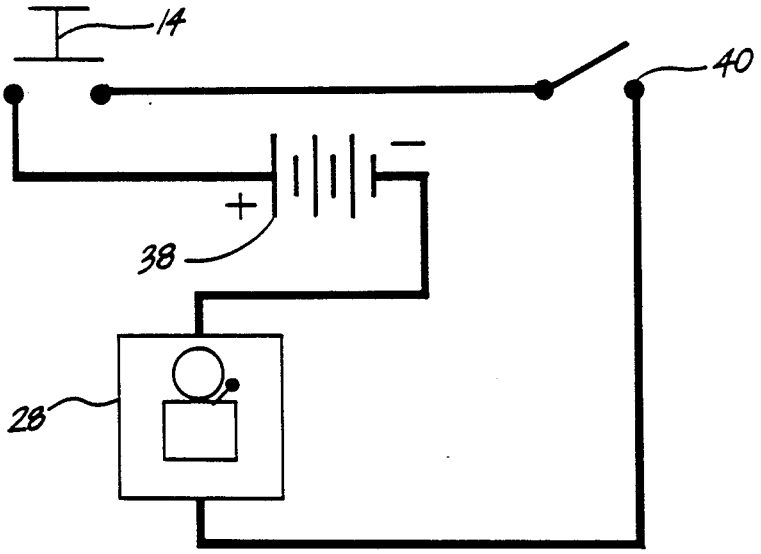
FIG. 12 is a schematic diagram illustrating the electrical components of the display case alarm of the present invention.

FIG. 12 illustrates the electrical connections of the various components of the display case alarm 10 of the present invention. The push button type enable/disable switch 14 may be of a type sold by RADIO SHACK as catalog number 275-011. The enable/disable switch 14 is connected in series with the mercury switch 40 and the audible alarm 28. The constructional details of the mercury switch 40 will be described subsequently. The audible alarm 28 may be a bell or buzzer, for example a buzzer of the type sold by RADIO SHACK as catalog number 273-055. A conventional nine volt battery 38 may be utilized to energize the buzzer 28. As may now be readily understood, When the switch 14 is in a closed position, closing of the mercury switch 40 will energize the audible alarm 28. When the switch 14 is an open position, the audible alarm 28 will not be energized even if the mercury switch 40 is closed. This allows a display case in which the alarm 10 of the present invention is mounted to be transported.

Figure 13:
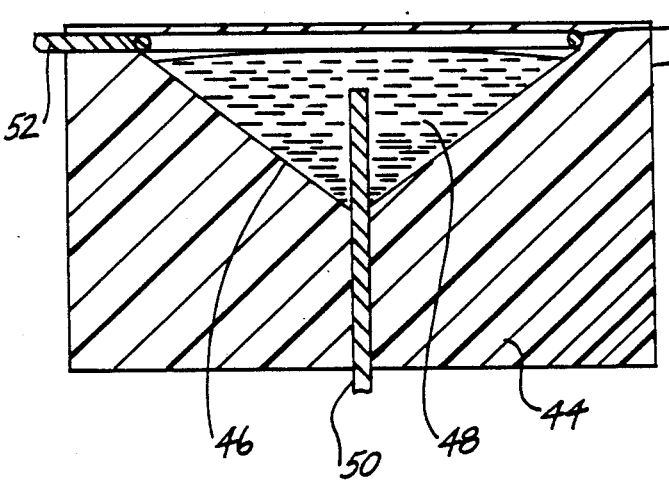
FIG. 13 is a cross sectional view illustrating the construction of a mercury switch according to a first embodiment of the present invention.

In FIG. 13, a cross sectional view illustrates a mercury switch 4 according to a first embodiment of the present invention. A conical recess 46 is formed in a rectangular block 44 of a plastic material. A pool of mercury 48 is encapsulated in the recess 46. A first conductor ring 42 is encapsulated in the plastic block 44 and is disposed around the largest diameter portion of the conical recess 46. A connecting lead 52 attached to the first conducting ring 42 extends to the exterior of the block 44. A second conductor wire 50 extends into the mercury pool 48 through the apex of the conical recess 46. The recess 46 is filled With mercury 48 to a level just slightly beneath the first conducting ring 42. When the block 44 is tipped slightly from the horizontal, the mercury 48 Will contact the conducting ring 42, thus closing the mercury switch 40. This construction has been found to result in an extremely sensitive switch which is highly resistant to damage. Additionally, the encapsulation of the mercury 48 in the block 44 prevents environmental contamination by release of the mercury 48.

Figure 14:
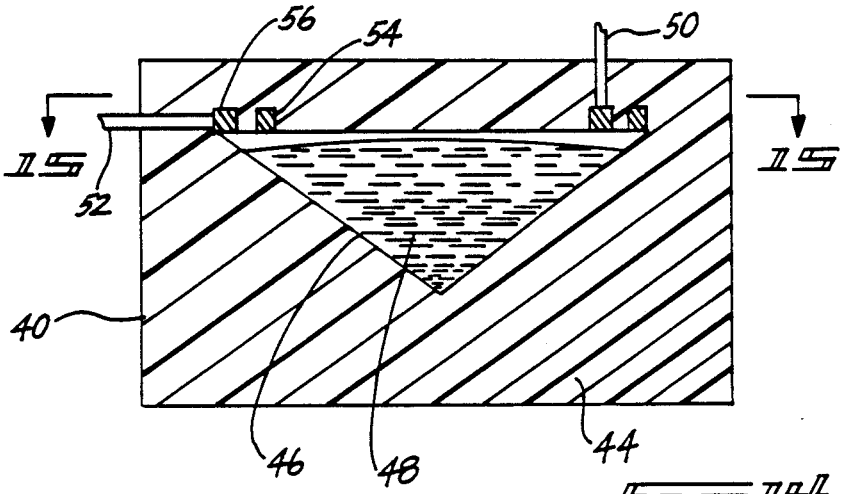
FIG. 14 is a cross sectional view illustrating a modified form of mercury switch according to a second embodiment of the present invention.

In FIG. 14, a modified form of mercury switch 40' according to a second embodiment of the present invention is illustrated. The mercury switch 40' utilizes a conical recess 46 nearly filled with a mercury pool 48 which is encapsulated in a rectangular block of plastic material 44. A first conductor ring 54 is disposed adjacent a widest diameter portion of the conical recess 46. A second larger diameter conductor ring 56 extends in coaxial relation around the first conductor ring 54. Electrical leads 50 and 52 are connected respectively to the first 54 and second conductor rings 56. When the mercury switch 40' is slightly tilted, the mercury pool 48 will contact the lower surfaces of the conductor rings 54 and 56, thus closing the switch 40'. It should be noted that the rings 54 and 56 are separated by the insulating plastic material of the block 44.

Figure 15:
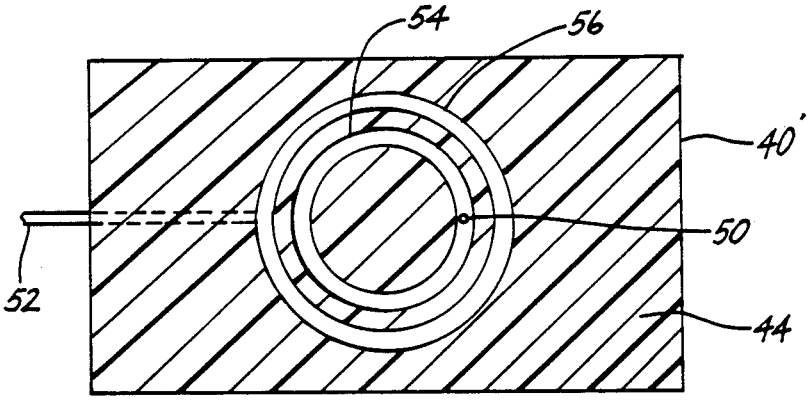
FIG. 15 is a cross sectional view taken along line 15—15 of FIG. 14, further illustrating the mercury switch construction according to the second embodiment of the present invention.

In FIG. 15, a cross sectional view taken along line 15—15 of FIG. 14 illustrates the relative positions of the conductor rings 54 and 56.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is no desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved display case alarm adapted to be mounted in an interior corner portion of a display case, comprising:

a generally L-shaped housing;

said housing having first and second legs each having rectangular interior and exterior side wall portions and a rectangular end face;

an enable/disable switch extending form said interior side wall portion of said first leg, said enable/disable switch located in an enclosed rectangular recess when said L-shaped housing is mounted in an interior corner portion of a display case;

an audible alarm in said housing, said audible alarm having a grill portion extending through said exterior side wall of said first leg;

a mercury switch in said housing, said mercury switch comprising a pool of mercury in a conical recess encapsulated in a block of plastic material, and first and second electrical conductors arranged to be contacted by said mercury pool upon tilting of said housing; and a battery in said housing, said enable/disable switch, said audible alarm, said mercury switch and said battery being connected in series.

2. The display case alarm of claim 1, wherein said first mercury switch electrical conductor comprises a metallic ring extending around a largest diameter end of said conical recess and said second electrical conductor comprises a metallic wire inserted into said mercury pool through an apex of said conical recess.

3. The display case alarm of claim 1, wherein said first and second mercury switch electrical conductors comprise coaxial electrically insulated metallic rings encapsulated in concentric relation in said block of plastic material adjacent a wide end of said conical recess.

4. In combination with a generally rectangular display case, the improvement comprising:

a display case alarm mounted in an interior corner portion of said display case, comprising:

a generally L-shaped housing;

said housing having first and second legs each having rectangular interior and exterior side wall portions and a rectangular end face;

said rectangular end faces abutting adjacent interior side walls of said display case forming a rectangular recess;

an enable/disable switch extending form said interior side wall portion of said first leg, said enable/disable switch located in said rectangular recess;

an aperture formed in a sidewall of said display case in alignment with said enable/disable switch;

an audible alarm in said housing, said audible alarm having a grill portion extending through said exterior side wall of said first leg;

a mercury switch in said housing, said mercury switch comprising a pool of mercury in a conical recess encapsulated in a block of plastic material, and first and second electrical conductors arranged to be contacted by said mercury pool upon tilting of said housing; and a battery in said housing, said enable/disable switch, said audible alarm, said mercury switch and said battery being connected in series.

5. The display case and alarm of claim 4, wherein said first mercury switch electrical conductor comprises a metallic ring extending around a largest diameter end of said conical recess and said second electrical conductor comprises a metallic wire inserted into said mercury pool through an apex of said conical recess.

6. The display case and alarm of claim 4, wherein said first and second mercury switch electrical conductors comprise coaxial electrically insulated metallic rings encapsulated in concentric relation in said block of plastic material adjacent a wide end of said conical recess.

* * * * *